US008278838B2

(12) United States Patent
Shen

(10) Patent No.: US 8,278,838 B2
(45) Date of Patent: Oct. 2, 2012

(54) DIMMER DEVICE WITH FEEDBACK FUNCTION

(75) Inventor: Shiu-Cheng Shen, Tainan (TW)

(73) Assignee: Netvox Technology Co. Ltd., Tainan (TW)

( * ) Notice: Subject to any disclaimer, the term of this patent is extended or adjusted under 35 U.S.C. 154(b) by 494 days.

(21) Appl. No.: 12/649,655

(22) Filed: Dec. 30, 2009

(65) Prior Publication Data

US 2010/0164397 A1 Jul. 1, 2010

(30) Foreign Application Priority Data

Dec. 31, 2008 (TW) ..... 97223866 U

(51) Int. Cl.
*G05F 1/00* (2006.01)

(52) U.S. Cl. ..... 315/291; 315/307; 315/308; 315/209 R

(58) Field of Classification Search ..... 315/185 R, 315/186, 193, 209 R, 210, 224, 291, 297, 315/299, 300, 301, 302, 307, 308, 313, 360, 315/361, 362

See application file for complete search history.

(56) References Cited

U.S. PATENT DOCUMENTS

2003/0107332 A1* 6/2003 Newman, Jr. et al. ..... 315/307
2005/0253538 A1* 11/2005 Shah et al. ..... 315/362
2008/0048579 A1* 2/2008 Vernondier et al. ..... 315/248
2008/0111498 A1* 5/2008 Budike ..... 315/291

* cited by examiner

*Primary Examiner* — Douglas W Owens
*Assistant Examiner* — Jianzi Chen
(74) *Attorney, Agent, or Firm* — Frommer Lawrence & Haug LLP; Ronald R. Santucci

(57) ABSTRACT

A dimmer device enables wireless control of intensity of light output of an electric light source and includes a light dimmer for coupling electrically with the light source. The light dimmer includes a power supply module for outputting a supply power, a dimmer module operable to vary the supply power to result in drive power that is supplied to the light source, a feedback module for generating a feedback signal in accordance with the drive power, the feedback signal corresponding to a current intensity of the light output of the light source, a wireless receiver unit for receiving a control signal from a remote controller and providing the control signal to the dimmer module for controlling the dimmer module to vary the supply power in accordance with the control signal, and a wireless transmitter unit for transmitting the feedback signal from the feedback module.

8 Claims, 3 Drawing Sheets

DIMMER DEVICE WITH FEEDBACK FUNCTION

CROSS-REFERENCE TO RELATED APPLICATION

This application claims priority of Taiwanese Patent Application No. 097223866, filed on Dec. 31, 2008 the disclosure of which is incorporated herein by reference.

BACKGROUND OF THE INVENTION

1. Field of the Invention

The invention relates to a dimmer device, more particularly to a dimmer device with a feedback function.

2. Description of the Related Art

A dimmer device is used with an electric light source to vary intensity of light output of the electric light source. The dimmer device is electrically coupled to a lighting socket and can be driven by a controller to vary drive voltage for the electric light source, thereby achieving the object of varying the intensity of the light output of the electric light source.

A dimmer device having a function of varying the intensity of the light output of an electric light source via remote control is known in the art. However, since the user is not provided with current intensity information of the light output of the electric light source, the extent the intensity of the light output is to be adjusted solely depends on the visual perception of the user to ambient light and thus results in user inconvenience in applications where the electric light source is installed in an office space or a study space. In addition, since the conventional dimmer device has a dedicated lighting socket and is not designed for use with an ordinary lighting socket, replacement of the ordinary lighting socket is required, thereby arising in more inconvenience and in waste of the ordinary lighting socket that is still usable. Therefore, there is room for improvement of the conventional dimmer device.

SUMMARY OF THE INVENTION

Therefore, an object of the present invention is to provide a dimmer device that has a feedback function and that is convenient to use.

Another object of the present invention is to provide a dimmer device that has a feedback function and that can turn on and turn off an electric light source automatically.

According to the present invention, a dimmer device is adapted for use with an electric light source and a remote controller, enables wireless control of intensity of light output of the electric light source, and comprises a light dimmer adapted to couple electrically with the electric light source. The light dimmer includes a power supply module for outputting a supply power, a dimmer module coupled electrically to the power supply module and operable to vary the supply power to result in drive power that is supplied to the electric light source for driving operation of the electric light source to generate the light output, a feedback module for generating a feedback signal in accordance with the drive power supplied to the electric light source, the feedback signal corresponding to a current intensity of the light output of the electric light source, and a wireless bi-directional transmission module coupled electrically to the dimmer module and the feedback module. The wireless bi-directional transmission module includes a wireless receiver unit adapted to wirelessly receive a control signal from the remote controller and configured to provide the control signal to the dimmer module for controlling the dimmer module to vary the supply power in accordance with the control signal, and a wireless transmitter unit coupled electrically to the feedback module and configured to wirelessly transmit the feedback signal.

Through the feedback mechanism of the light dimmer of the dimmer device according to this invention, current intensity information of the light output of an electric light source can be provided to a remote controller for display to a user, thereby enabling the user to refer to the same when varying the intensity of the light output of the electric light source.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
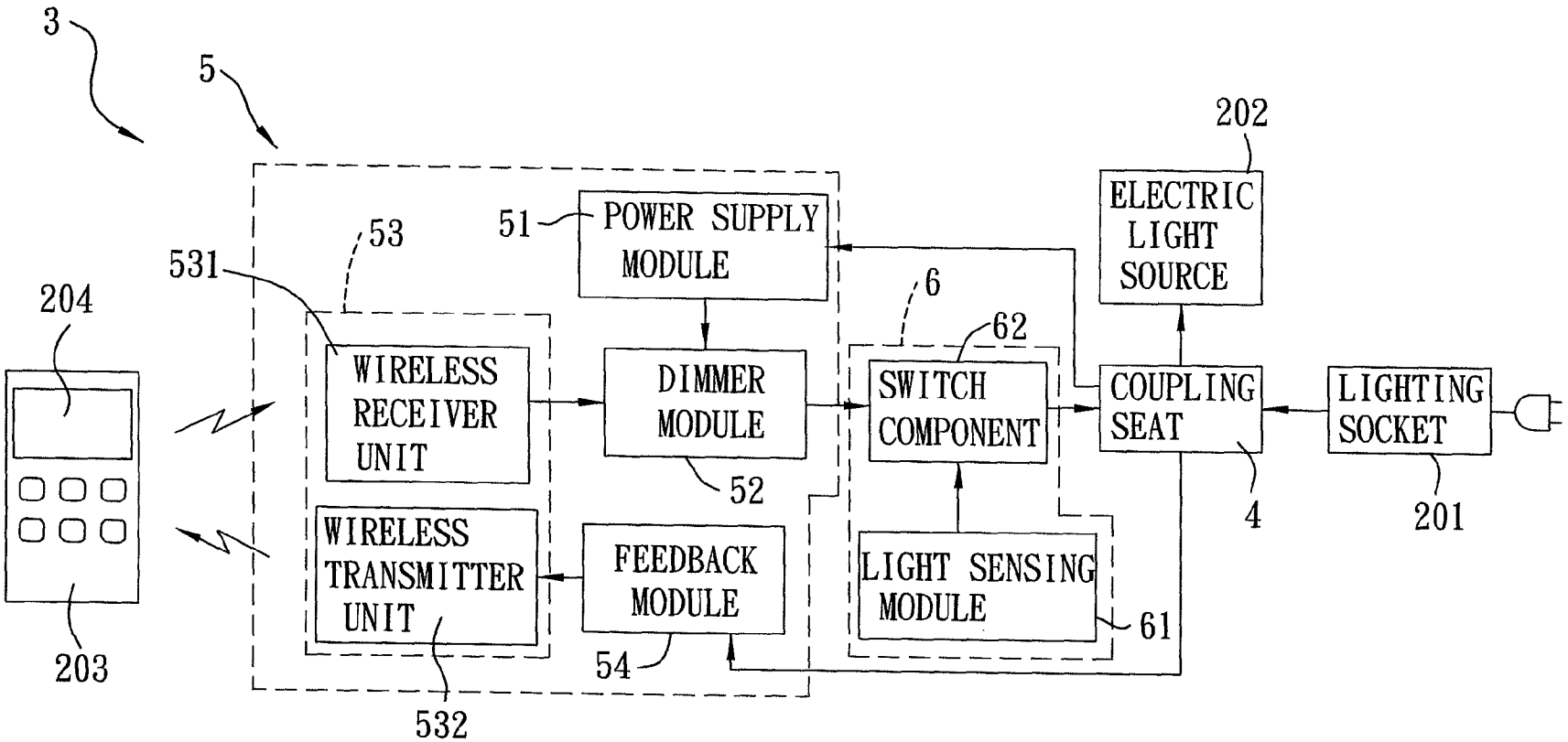
FIG. 1 is a functional block diagram of the preferred embodiment of a dimmer device with feedback function according to the present invention.
Figure 2:
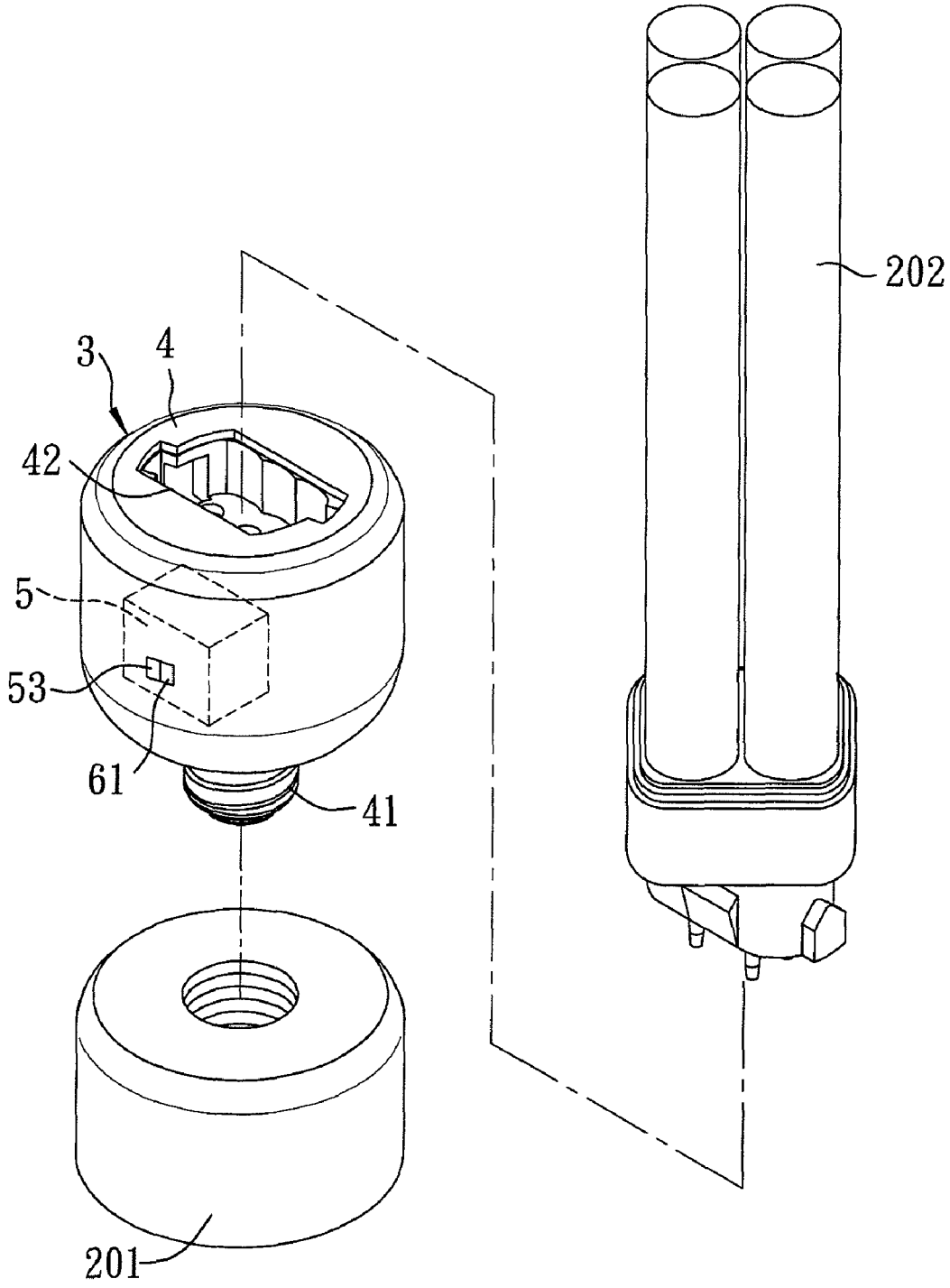
FIG. 2 is a perspective view illustrating the dimmer device of the preferred embodiment, an electric light source, and a lighting socket.

Referring to FIGS. 1 and 2, the preferred embodiment of a dimmer device 3 with feedback function according to the present invention is adapted for coupling electrically to a lighting socket 201 and to an electric light source 202, and is adapted for communicating wirelessly with a remote controller 203. While the electric light source 202 is exemplified as an energy-saving light bulb in this embodiment, application of the present invention should not be limited thereto.

The dimmer device 3 includes a coupling seat 4 for coupling threadedly with the lighting socket 201 and for coupling electrically and removably with the electric light source 202, a light dimmer 5 installed in and coupled electrically to the coupling seat 4, and a controller 6 installed in the coupling seat 4 and coupled electrically to the light dimmer 5.

The coupling seat 4 has a socket coupling portion 41 for coupling threadedly with and receiving input power from the lighting socket 201, and a source coupling portion 42 for insertion of and electrical connection with the electric light source 202.

While the socket coupling portion 41 is configured for coupling threadedly with the lighting socket 201, and the source coupling portion 42 is configured for insertion of the electric light source 202 in the present embodiment, other configurations may be employed for each of the socket coupling portion 41 and the source coupling portion 42 as long as they are able to connect electrically with a conventional lighting socket and a conventional electric light source, respectively.

The light dimmer 5 includes a power supply module 51 coupled electrically to the socket coupling portion 41 and configured to convert the input power received from the socket coupling portion 41 into a supply power suitable for driving operation of the electric light source 202, a dimmer module 52 coupled electrically to the power supply module 51, a wireless bi-directional transmission module 53 coupled electrically to the dimmer module 52 and capable of wireless bi-directional signal transmission with the remote controller 203, and a feedback module 54 coupled electrically to the wireless bi-directional transmission module 53 and the coupling seat 4.

The dimmer module 52 operates in response to control signals from the remote controller 203 for varying the supply power from the power supply module 51 to result in drive power that is supplied to the electric light source 202 through the coupling seat 4, thereby driving operation of the electric light source 202 to generate the light output.

The feedback module 54 generates a feedback signal in accordance with the drive power applied to the source coupling portion 42, i.e., the drive power supplied to the electric light source 202. The feedback signal corresponds to a current intensity of the light output of the electric light source 202, and is outputted by the feedback module 54 to the wireless bi-directional transmission module 53.

The wireless bi-directional transmission module 53 includes a wireless receiver unit 531 coupled electrically to the dimmer module 52, and a wireless transmitter unit 532 coupled electrically to the feedback module 54. The wireless receiver unit 531 is for receiving control signals wirelessly transmitted by the remote controller 203 and for providing the control signals to the dimmer module 52, thereby controlling the dimmer module 52 to vary the supply power from the power supply module 51 in accordance with the control signals so as to result in the drive power for driving operation of the electric light source 202 to generate the light output with the adjusted intensity. The wireless transmitter unit 532 is for wirelessly transmitting the feedback signal outputted by the feedback module 54 to the remote controller 203.

The controller 6 includes a light sensing module 61 exposed to the ambient from an outer surface of the coupling seat 4, and a switch component 62 coupled electrically to the light sensing module 61 and coupled electrically between the dimmer module 52 and the source coupling portion 42. Depending on the intensity of ambient light sensed thereby, the light sensing module 61 controls opening and closing of the switch component 62 to make or break electrical connection between the source coupling portion 42 and the dimmer module 52. In particular, when the intensity of ambient light drops below a preset threshold value, the light sensing module 61 controls the switch component 62 to make electrical connection between the source coupling portion 42 and the dimmer module 52 such that the dimmer module 52 is able to output the drive power that is supplied to the electric light source 202 via the source coupling portion 42, thereby turning on the electric light source 202. On the other hand, when the intensity of ambient light is above a preset threshold value, the light sensing module 61 controls the switch component 62 to break electrical connection between the source coupling portion 42 and the dimmer module 52 such that the source coupling portion 42 is unable to receive the drive power, thereby turning off the electric light source 202. While the light sensing module 61 includes a light sensitive resistor in this embodiment, the present invention is not limited in this respect.

To use the dimmer device 3, the coupling seat 4 is coupled threadedly and directly to the lighting socket 201, and receives input power necessary for operation of the light dimmer 5, the controller 6 and the electric light source 202 from the lighting socket 201. The electric light source 202 is then coupled electrically to the coupling seat 4.

Thereafter, when the light sensing module 61 senses that the intensity of ambient light has dropped below the preset threshold value, the light sensing module 61 controls the switch component 62 to make electrical connection between the source coupling portion 42 and the dimmer module 52 such that the drive power from the dimmer module 52 is supplied to the source coupling portion 42 for driving the electric light source 202 to generate the light output. At this time, the user can vary the intensity of the light output of the electric light source 202 through the remote controller 203.

When the user operates the remote controller 203 to vary the intensity of the light output of the electric light source 202, the wireless receiver unit 531 receives the control signal wirelessly transmitted by the remote controller 203 and provides the control signal to the dimmer module 52. The dimmer module 52 then varies the supply power from the power supply module 51 according to the control signal to result in adjusted drive power that is supplied to the electric light source 202 through the switch component 62 and the source coupling portion 42, thereby varying the intensity of the light output of the electric light source 202. At the same time, the feedback module 54 generates a feedback signal in accordance with the drive power supplied to the electric light source 202, and outputs the feedback signal to the wireless transmitter unit 532 for wireless transmission to the remote controller 203. With reference to the feedback signal, the remote controller 203 then shows an intensity value corresponding to the current intensity of the light output of the electric light source 202 on a display 204 thereof, so as to provide assistance to the user when the user intends to make further adjustments in order to obtain a desired intensity of the light output of the electric light source 202. In other embodiments, the feedback module 54 may transmit, through the wireless transmitter unit 532, the feedback signal to a computer (not shown) or a monitoring system (not shown) configured for wireless communication with the wireless bi-directional transmission module 53.

In this embodiment, the feedback module 54 generates the feedback signal in accordance with at least one of an electric voltage value and an electric current value of the drive power that is applied by the dimmer module 52 to the coupling seat 4.

Figure 3:
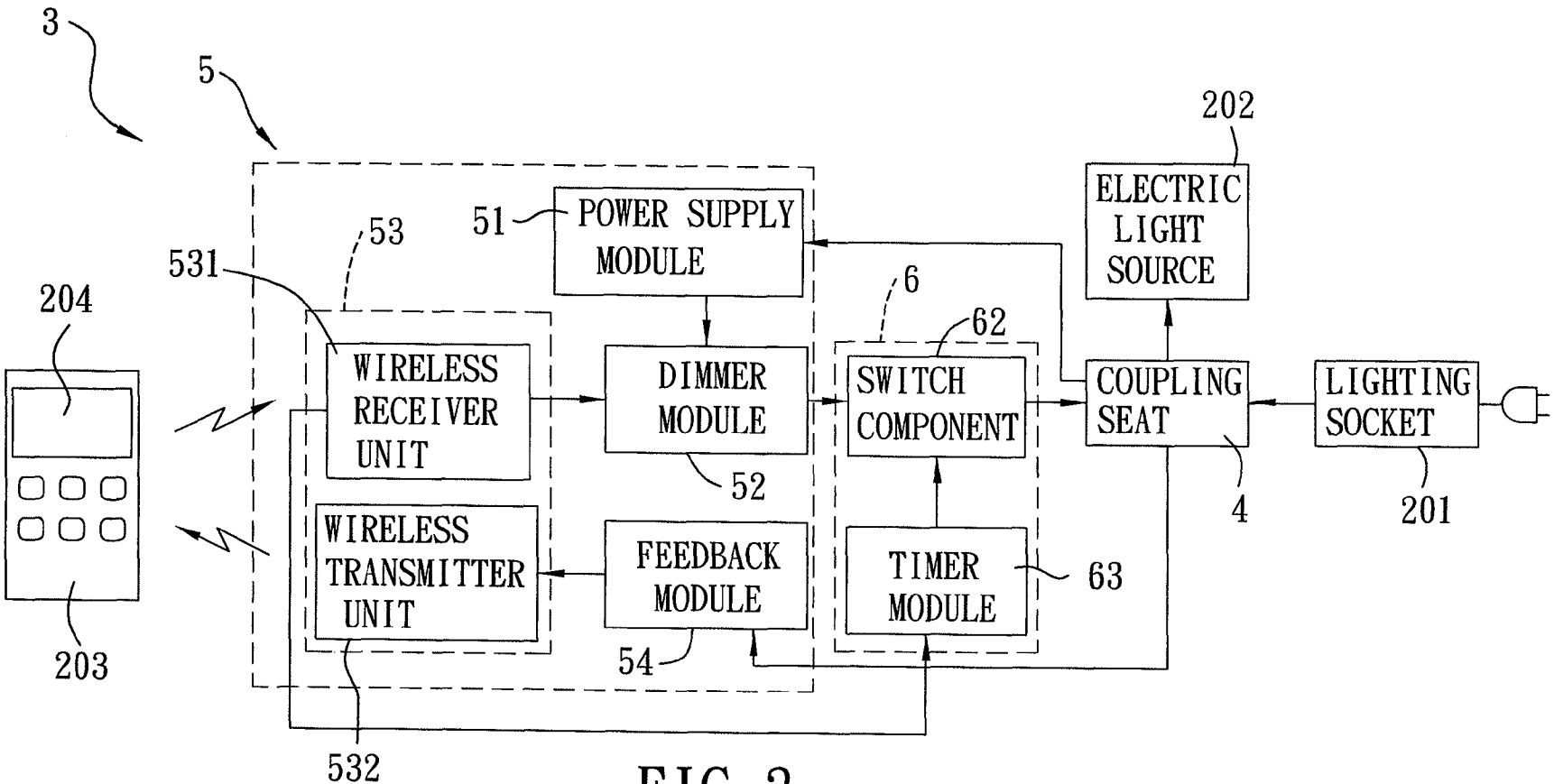
FIG. 3 is a functional block diagram to illustrate a modification of the preferred embodiment.

FIG. 3 is a modification of the preferred embodiment, which differs from the dimmer device 3 shown in FIG. 1 in the configuration of the controller 6. In FIG. 3, a timer module 63 is used instead of the light sensing module 61 in FIG. 1. The timer module 63 is coupled electrically to the wireless receiver unit 531 of the wireless bi-directional transmission module 53, and is designed such that on and off times of the switch component 62 can be set through the remote controller 203. Accordingly, when the timer module 63 has counted to the preset on time, the timer module 63 controls the switch component 62 to make electrical connection between the coupling seat 4 and the light dimmer 5, and when the timer module 63 has counted to the preset off time, the timer module 63 controls the switch component 62 to break electrical connection between the coupling seat 4 and the light dimmer 5. It should be noted that, in practice, it is not essential for the timer module 63 to be set through the remote controller 203. Instead, the on and off times of the switch component 62 can be programmed beforehand in the timer module 63.

Moreover, in practice, the controller 6 may be omitted in other embodiments of the invention. In such embodiments, the dimmer module 52 is coupled directly to the source coupling portion 42, such that the electric light source 202 can be driven directly by the dimmer module 52 to generate the light output.

In summary, due to the presence of the coupling seat 4, the dimmer device 3 of this invention can be used with an ordinary lighting socket 201 to provide intensity adjustment functionality to an electric light source 202. In addition, through the feedback mechanism of the light dimmer 5, current intensity information of the light output of the electric light source 202 can be provided to and displayed by the remote controller 203 for reference by the user. Furthermore, failure of the electric light source 202 does not require replacement of the dimmer device 3 and only requires replacement of the broken electric light source 202 with a new one.

Moreover, through the inclusion of the controller 6, the electric light source 202 may be turned on and turned off automatically, thereby resulting in greater convenience.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A dimmer device adapted for use with an electric light source and a remote controller, said dimmer device enabling wireless control of intensity of light output of the electric light source and comprising a light dimmer adapted to couple electrically with the electric light source, said light dimmer including:

a power supply module for outputting a supply power;

a dimmer module coupled electrically to said power supply module and operable to vary the supply power to result in drive power that is supplied to the electric light source for driving operation of the electric light source to generate the light output;

a feedback module for generating a feedback signal in accordance with the drive power supplied to the electric light source, the feedback signal corresponding to a current intensity of the light output of the electric light source; and a wireless bi-directional transmission module including a wireless receiver unit adapted to wirelessly receive a control signal from the remote controller and configured to provide the control signal to said dimmer module for controlling said dimmer module to vary the supply power in accordance with the control signal, and a wireless transmitter unit coupled electrically to said feedback module and configured to wirelessly transmit the feedback signal.

2. The dimmer device as claimed in claim 1, further comprising a coupling seat for coupling electrically with the electric light source, said light dimmer being installed in said coupling seat, said dimmer module being coupled to said coupling seat to permit supply of the drive power to the electric light source that is coupled to said coupling seat, said feedback module being coupled electrically to said coupling seat and generating the feedback signal in accordance with the drive power that is received by said coupling seat from said dimmer module.

3. The dimmer device as claimed in claim 2, the dimmer device being further adapted for use with a lighting socket, wherein said coupling seat has a socket coupling portion adapted for coupling electrically with the lighting socket and for providing input power from the lighting socket to said power supply module, and a source coupling portion adapted for coupling electrically with the electric light source and disposed to provide the drive power from said dimmer module to the electric light source.

4. The dimmer device as claimed in claim 2, the dimmer device being further adapted for use with a lighting socket, wherein:

said coupling seat has a socket coupling portion adapted for coupling electrically with the lighting socket and for receiving input power from the lighting socket, and a source coupling portion adapted for coupling electrically with the electric light source;

said dimmer device further comprising a switch component coupled electrically between said source coupling portion and said dimmer module and operable to make or break electrical connection between said source coupling portion and said dimmer module.

5. The dimmer device as claimed in claim 4, further comprising a light sensing module that is coupled electrically to said switch component and that controls opening and closing of said switch component according to intensity of ambient light sensed by said light sensing module.

6. The dimmer device as claimed in claim 4, further comprising a timer module that is coupled electrically to said switch component and that controls opening and closing of said switch component according to preset on and off times of said switch component.

7. The dimmer device as claimed in claim 6, wherein said timer module is coupled electrically to said wireless receiver unit, and the preset on and off times of said switch component are set in said timer module through a control signal received by said timer module from said wireless receiver unit.

8. The dimmer device as claimed in claim 2, wherein said feedback module generates the feedback signal in accordance with at least one of an electric current value and an electric voltage value of the drive power that is received by said coupling seat from said dimmer module.

* * * * *